US005779185A

United States Patent [19]

Masuda et al.

[11] Patent Number: 5,779,185

[45] Date of Patent: Jul. 14, 1998

[54] FILM SPLICING DEVICE

[75] Inventors: Shigeru Masuda; Masayuki Kojima, both of Wakayama, Japan

[73] Assignee: Noritsu Koki Co., Ltd., Wakayama, Japan

[21] Appl. No.: 712,544

[22] Filed: Sep. 11, 1996

[30] Foreign Application Priority Data

Sep. 18, 1995 [JP] Japan ..... 7-238580
Oct. 13, 1995 [JP] Japan ..... 7-265507

[51] Int. Cl.[6] ..... B65H 19/18

[52] U.S. Cl. ..... 242/556; 242/332.4; 242/532.1

[58] Field of Search ..... 242/556, 532.1, 242/532.4, 332.4; 156/502

[56] References Cited

U.S. PATENT DOCUMENTS

| | | | |
|---|---|---|---|
| 1,655,297 | 1/1928 | Thornton . | |
| 2,433,446 | 12/1947 | Foster . | |
| 2,590,678 | 3/1952 | Caim . | |
| 2,632,361 | 3/1953 | Krows | 242/332.4 X |
| 4,110,774 | 8/1978 | Krehbiel et al. . | |
| 4,134,526 | 1/1979 | Weisser . | |
| 4,860,044 | 8/1989 | Kanai et al. . | |
| 5,078,828 | 1/1992 | Marglin | 156/502 X |
| 5,463,441 | 10/1995 | Yamaguchi . | |
| 5,566,897 | 10/1996 | Yago et al. | 242/532.4 X |

FOREIGN PATENT DOCUMENTS

| | | | |
|---|---|---|---|
| 0 624 822 | 11/1994 | European Pat. Off. . | |
| 4124022 | 1/1993 | Germany | 242/556 |

*Primary Examiner*—Donald P. Walsh
*Assistant Examiner*—William A. Rivera
*Attorney, Agent, or Firm*—Wenderoth, Lind & Ponack, L.L.P.

[57] ABSTRACT

A splicing device which can automatically connect films to a leader, includes a table for supporting the leader. The table has an opening over which is provided a support portion for supporting a film cartridge. A fixed guide and a movable guide are provided under the opening. Defined between the fixed and movable guides is a film turning passage having a film outlet and inlet that face the opening. A feed roller and a press roller are provided at the inlet of the film turning passage. With the leader set in position on the table, a swing arm is pivoted to catch the film end protruding from the film cartridge supported by the support portion. The swing arm is further pivoted to guide the film end through a second hole formed in the leader into the film turning passage. In this state, the feed roller is rotated to feed the film through the film turning passage and into the first hole formed in the leader while resiliently deforming prongs extending across the first hole. Then, the feed roller is reversed to pull the film backward until the prongs engage in holes formed in the film at its leading end. The film is thus connected to the leader.

9 Claims, 14 Drawing Sheets

FILM SPLICING DEVICE

BACKGROUND OF THE INVENTION

This invention relates to a film splicing device used to connect a photographic film to be developed to a leader.

In order to develop films in an automatic leader-guided film developing machine, it is necessary to connect films to a flexible leader to feed the films through the developing unit by pulling the leader.

Such a leader is made of a flexible synthetic resin sheet and is formed with holes arranged longitudinally at equal intervals. The leader is fed by sprockets that engage these holes.

Ordinarily, splicing tape is used to connect films to leaders. But it is troublesome to stick splicing tape and then remove it after developing films. Also, the use of such splicing tape is inconvenient because a special workbench for splicing is needed to couple each film to a leader with splicing tape at a predetermined position with high accuracy. Further, splicing tape is not economical because it is not recyclable.

In order to solve these problems, there has been proposed a coupling arrangement for coupling films to a leader as shown in FIG. 9 (Japanese Patent Application 7-230253).

In this coupling arrangement, leader L is provided with a first hole 1 and a second hole 2 on each of opposite sides of leader feed holes a. Prongs 3 extend across the first hole 1 in the feed direction of the leader. Each prong 3 has a front end, with respect to the feed direction of the leader, integrally connected to the leader L, and a rear end supported on an edge of the first hole 1. A film F is coupled to the leader by inserting the film end into the second hole 2 and then into the first hole 1 so that the prongs 3 engage in holes 4 formed in the tip of the film F.

With this coupling arrangement, films can be connected easily and reliably to a leader L at predetermined positions of the leader.

An object of this invention is to provide a film splicing device which, in this coupling arrangement, makes it possible to automatically connect films to a leader.

SUMMARY OF THE INVENTION

According to this invention, there is provided a film splicing device for splicing a film to a leader formed with a first hole, a second hole and protrusions, the film splicing device being adapted to guide an end of the film through the second hole formed in the leader and then the first hole formed in the leader adjacent the second hole while resiliently deforming the protrusions formed on the leader and extending across the first hole, and to pull back the film with the protrusions being resiliently deformed to cause the protrusions to engage in holes formed in the film. The film splicing device includes a table for supporting the leader, the table having a film inserting elongated opening, a film cartridge support portion located over the opening for supporting a film cartridge in which is wound a film, a fixed guide and a movable guide provided under the table, the movable guide being movable above the fixed guide in the direction of a width of the table to and away from a position right over the fixed guide. The movable guide and the fixed guide are so positioned that a film turning passage is defined therebetween when the movable guide is right over the fixed guide. A feed roller is movable in the direction of the width of the table together with the movable guide so as to be located near an inlet of the film turning passage when the film turning passage is formed. A press roller is pressed against the feed roller with a film sandwiched therebetween. A film pulling means pulls the film out of the film cartridge supported on the support portion and guiding the film through the second hole formed in the leader placed on the table into the inlet of the film turning passage.

The film pulling means may comprise a swing arm pivotable from under the table toward the table, and an arcuate plate mounted on a free end of the swing arm and adapted to be inserted in the second hole in the leader, the arcuate plate having catches at its free end adapted to engage holes formed in the film.

Other features and objects of the present invention will become apparent from the following description made with reference to the accompanying drawings, in which:

DETAILED DESCRIPTION OF THE PREFERRED EMBODIMENT

Embodiments of this invention will now be described with reference to the drawings.

(First Embodiment)

Figure 1:
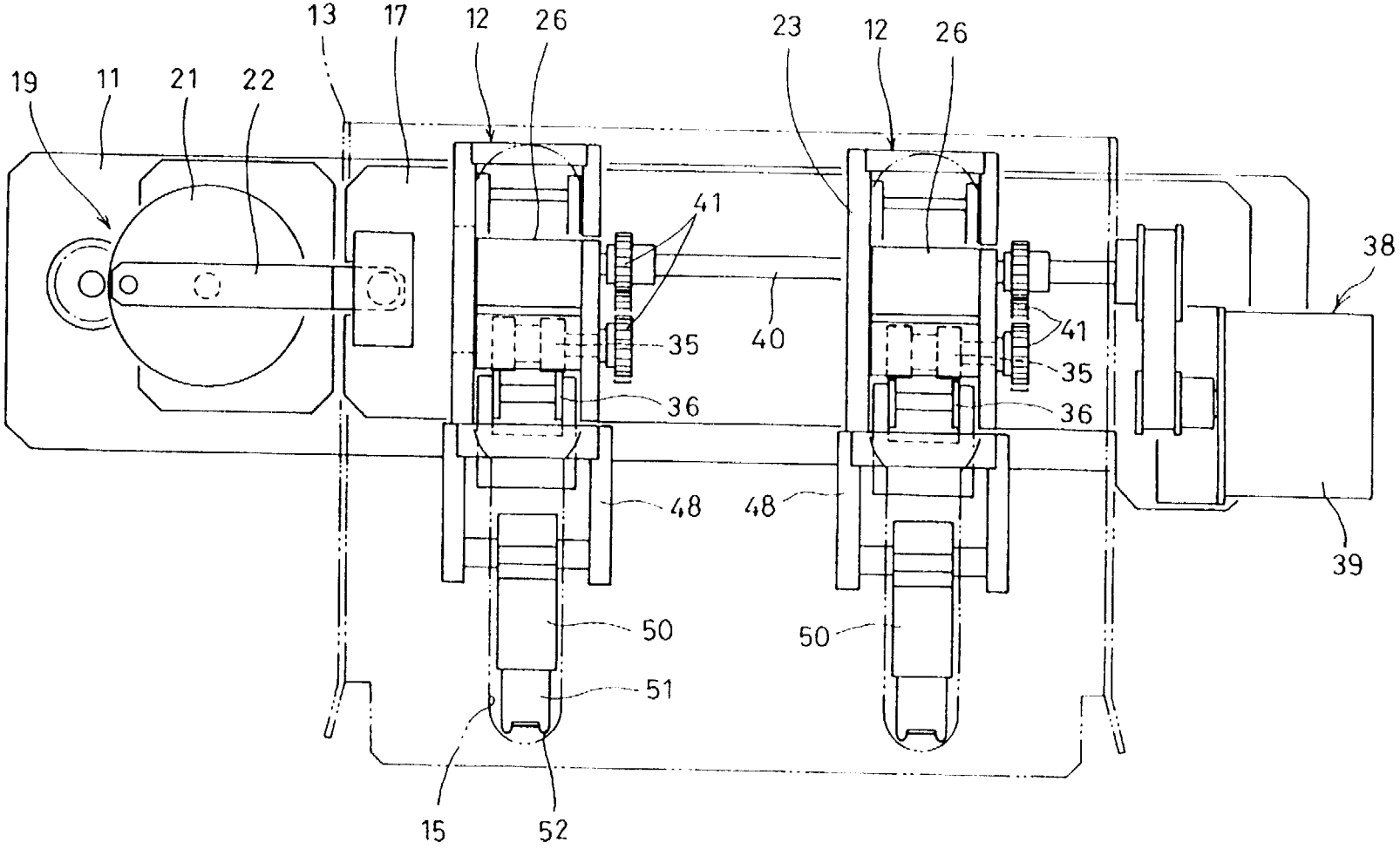
FIG. 1 is a plan view of a splicing device embodying this invention.
Figure 2:
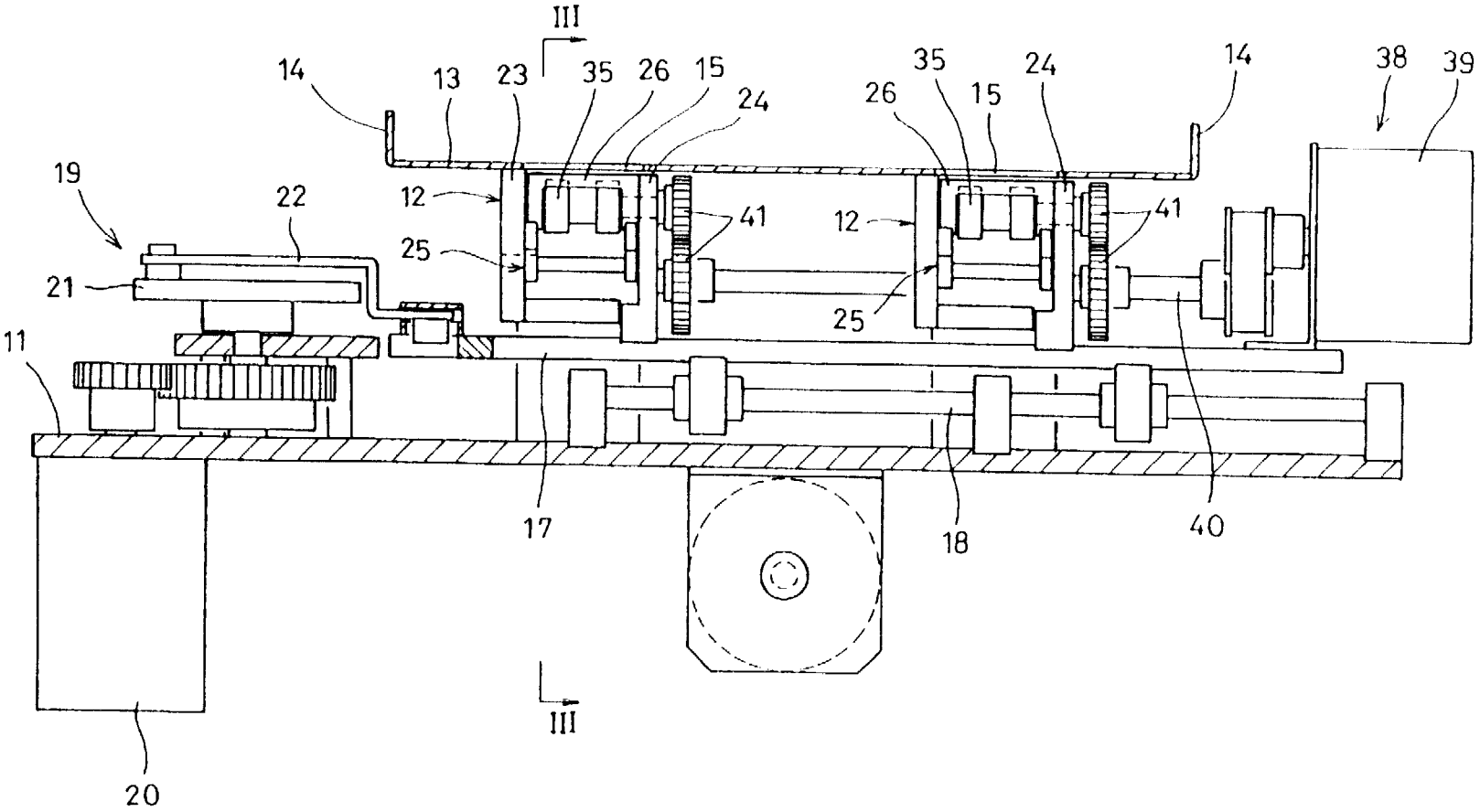
FIG. 2 is a vertical sectional front view of FIG. 1.
Figure 3:
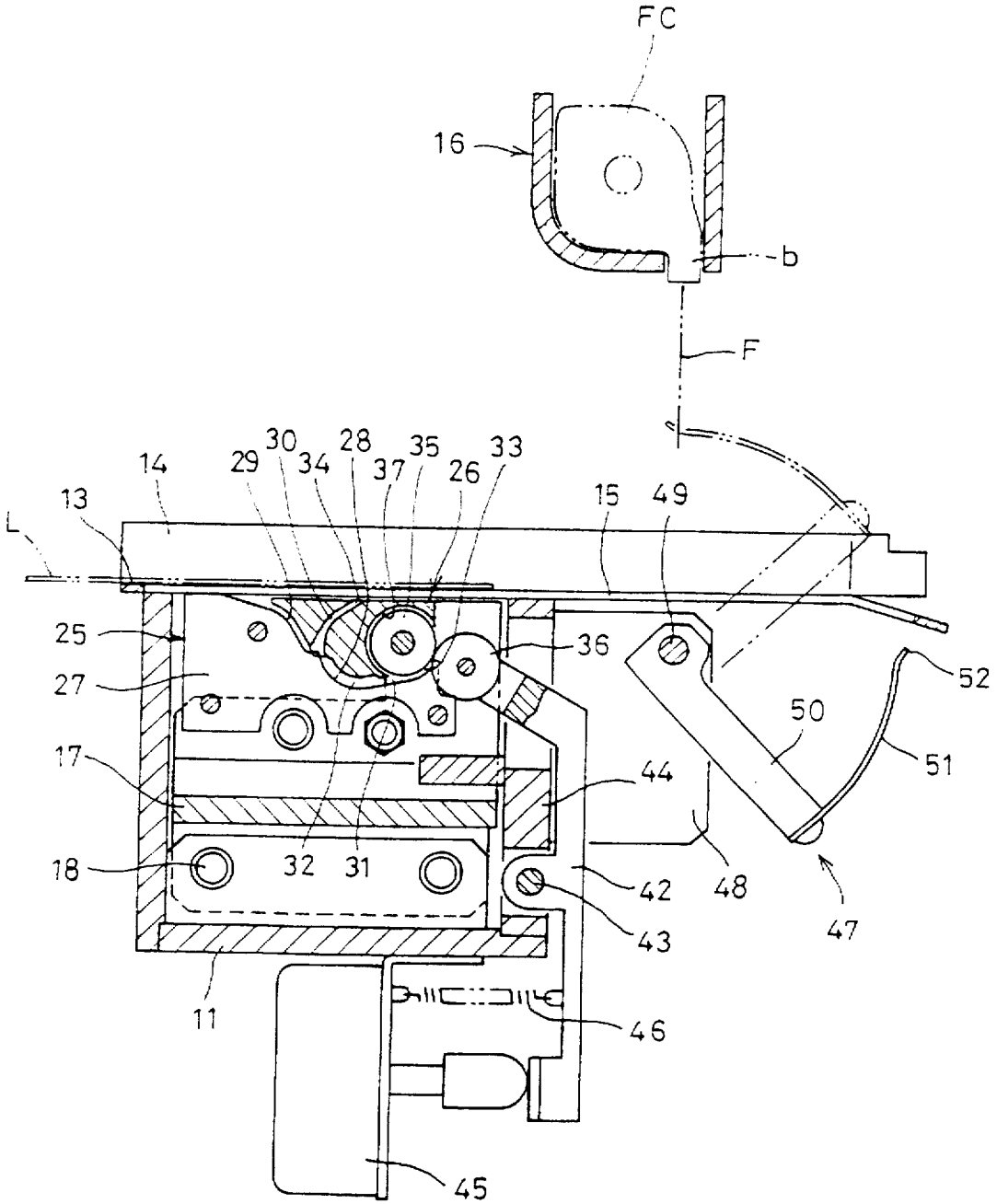
FIG. 3 is a sectional view taken along line III-III of FIG. 2.

As shown in FIGS. 1–3, a pair of table support frames 12 are provided on a base plate 11. A table 13 is supported on the support frames 12.

The table 13 has a pair of side plates 14 for positioning opposite edges of a leader L, and film inserting openings 15 elongated back to forth and located opposite to a first hole 1 and a second hole 2 of a leader L (FIG. 6) positioned by the side plates 14.

As shown in FIG. 3, a support portion 16 for supporting a film cartridge FC is provided over each opening 15 of the table 13. The film cartridge FC is set in the support portion 16 with a leading end of film F protruding from a film inlet/outlet b by a predetermined length.

Referring to FIG. 2, a slide plate 17 is provided between the base plate 11 and the table 13 so as to be slidable along a guide shaft 18 provided over the base plate 11. Plate 17 is moved by a driving unit 19 mounted on the base plate 11 in the direction of the width of the table 13 .

The driving unit 19 comprises a motor 20 mounted on the underside of the base plate 11, and a disk 21 rotated by the motor 20. The disk 21 is coupled at its outer peripheral portion to the slide plate 17 through a link 22 so that the slide plate 17 is moved by rotating the disk 21.

Each of the pair of table support frames 12 has a side plate 23 extending along one side of each opening 15 of the table 13. The slide plate 17 has guide support plates 24 provided opposite to the respective side plates 23 (FIG. 2).

Figure 5:
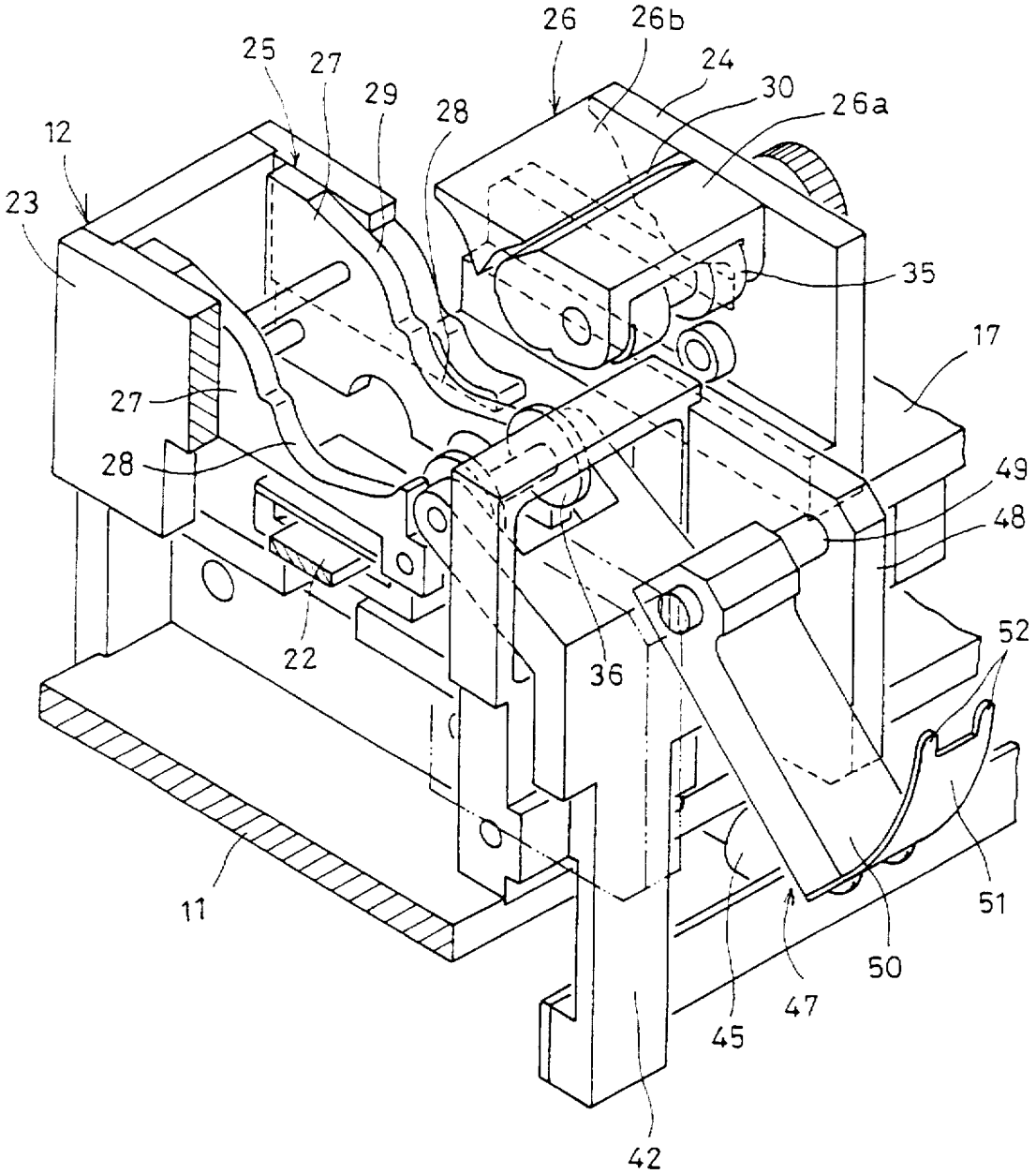
FIG. 5 is a partial perspective view of the same.

A fixed guide 25 and a movable guide 26 are provided between each side plate 23 and guide support plate 24. As seen in FIGS. 3 and 5, the fixed guide 25 comprises two guide plates 27 for guiding opposite sides of film F. The top side of each guide plate 27 has a concave portion 28 and a convex portion 29. The guide plates 27 are fixed to the side plate 23.

The movable guide 26 has a width substantially equal to the width of a film F and is fixed to the guide support plate 24. Guide 26 is moved between a position right over the fixed guide 25 and a position in which it is completely spaced from the fixed guide 25 by sliding the slide plate 17.

The movable guide 26 comprises separate front and rear guide members **26*a* and 26*b* (FIG. 5). A passage 30 is defined between the guide members 26*a* and 26*b* and forms a film turning passage 32 in communication with a passage 31 defined between the front member 26*a* and the guide plate 27 (FIG. 3**).

The film turning passage 32 has a film inlet 33 and a film outlet 34 located opposite to each opening 15 formed in the table 13.

A feed roller 35 and a press roller 36 are provided near the inlet 33 of the film turning passage 32. The feed roller 35 is set in a recess 37 formed in the underside of the front guide member **26*a* and is rotated by a driving unit 38 mounted on the slide plate 17 (FIG. 2**).

As seen in FIGS. 1 and 2, the driving unit 38 comprises a motor 39, a driving shaft 40 rotated by the motor 39, and gear trains 41 for transmitting the rotation of the driving shaft 40 to the respective feed roller 35.

Referring to FIG. 3, the press roller 36 is rotatably mounted on the top end of a roller arm 42. The roller arm 42 is pivotally supported at its mid-portion on a support member 44 provided on the base plate 11 by means of a pin 43.

A solenoid 45 mounted on the underside of the base plate 11 biases the roller arm 42 to pivot in such a direction that the press roller 36 comes into contact with the feed roller 35. A spring 46 biases the roller arm 42 in the opposite direction. Provided in front of the roller arm 42 is a film pulling means 47 for pulling the film F hanging from the film cartridge FC into the film turning passage 32 through inlet 33.

Figure 6:
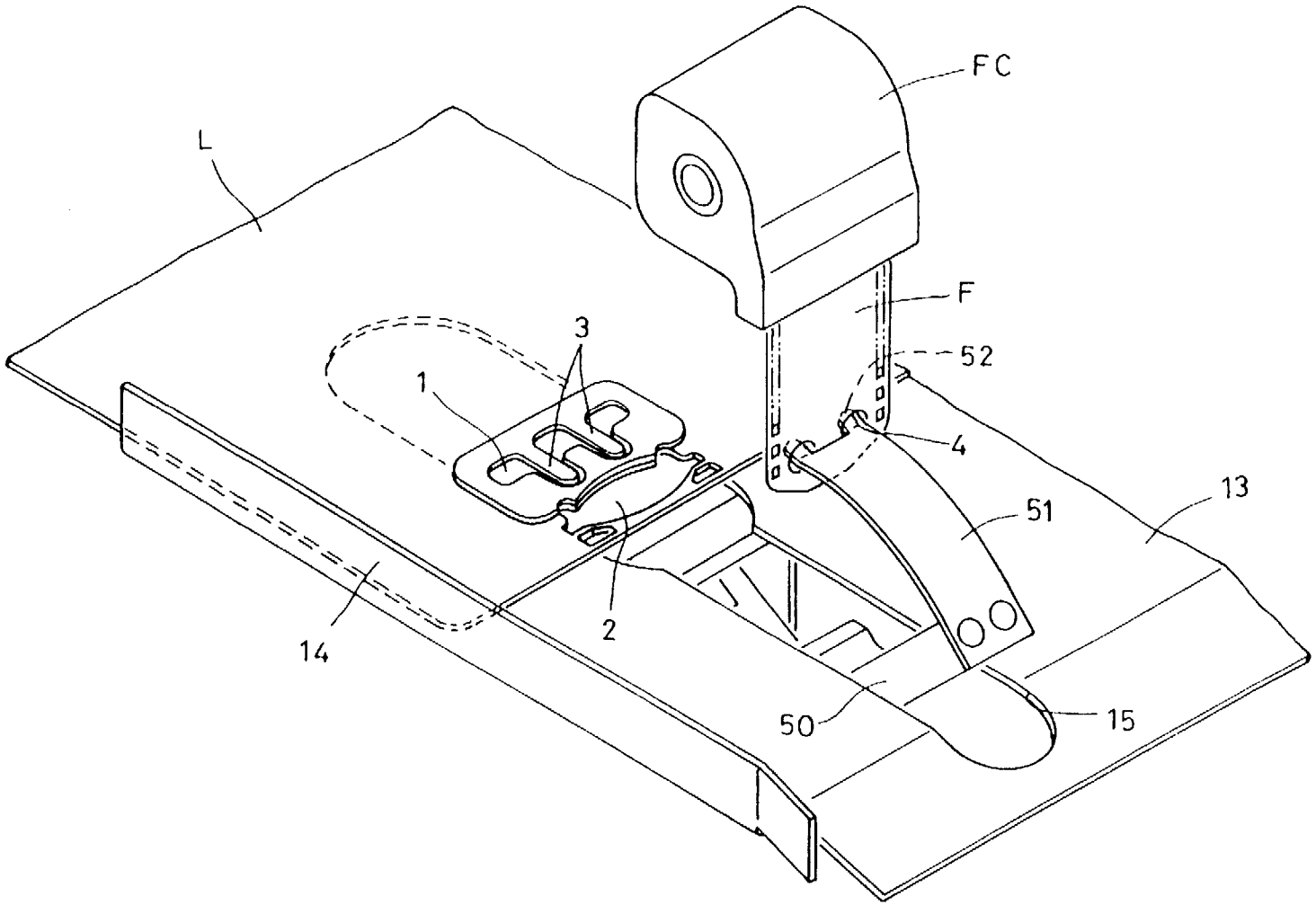
FIG. 6 is a perspective view of the same showing how a film wound in a film cartridge is pulled out.

The film pulling means 47 comprises a shaft support plate 48 fixed to the base plate 11, a rotary shaft 49 mounted on the shaft support plate 48 and rotated in either direction by an unshown driving unit, a swing arm 50 having one end fixed to the rotary shaft 49, and an arcuate plate 51 fixed to the other end of the swing arm 50. The arcuate plate 51 is provided at its leading end with catches 52 capable of engaging the holes 4 in the film F (FIG. 6). Plate 51 has a width to be received in the second hole 2 formed in the leader L.

To pull and guide the film F hanging from the film cartridge FC into the film turning passage 32 with the film pulling means 47, the swing arm 50 is pivoted upward from under the table 13 until the catches 52 are engaged in the holes 4 in the film F (FIG. 6), and then the swing arm 50 is pivoted further until the film end is pulled and guided into the passage 32.

Figure 7A:
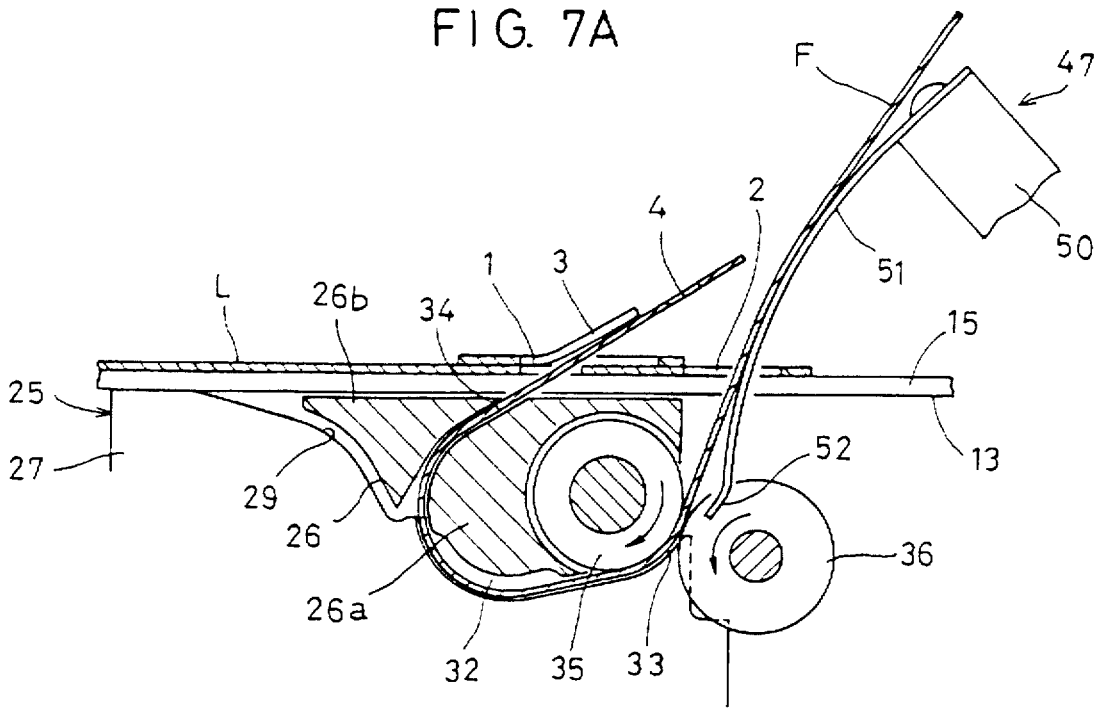
FIG. 7A and 7B are sectional views showing by stages how a film is spliced to a leader.
Figure 7B:
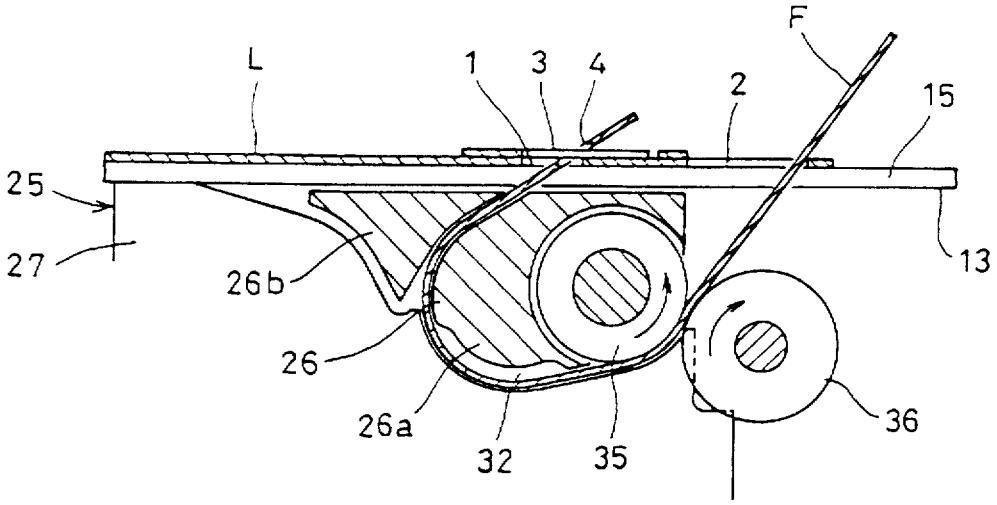

To splice each film to a leader L with the splicing device of this embodiment, the leader L is set on the table 13 with its first hole 1 opposite the outlet 34 of the film turning passage 32 as shown in FIGS. 6–7B.

Film cartridge FC is set in the support portion 16 (FIG. 3) with the leading end of the film F wound in the cartridge FC protruding from its inlet/outlet by a predetermined length.

With the leader and each film set in position in the manner described above, the swing arm 50 is pivoted upward. While it is swung upward, the catches 52 of the arcuate plate 51 engage the holes 4 in the film F as shown in FIG. 6. By further pivoting the swing arm 50, the film F is pulled out of the film cartridge FC until its leading end is guided through the second hole 2 in the leader L to the inlet 33 of the film turning passage 32. In this position, the catches 52 disengage from the holes 4, freeing the film.

In this state, the movable guide 26 is moved to the position right over the fixed guide 25, while the press roller 36 is spaced from the feed roller 35.

When the film end has been inserted into the inlet 33 of the film turning passage 32, the solenoid 45 shown in FIG. 3 is activated to press the press roller 36 against the feed roller 35 with the end of the film F sandwiched therebetween.

When the press roller 36 is pressed against the feed roller 35, the motor 39 shown in FIG. 2 is activated to rotate the feed roller 35 in the direction of the arrow shown in FIG. 7A. The film F is thus fed into the film turning passage 32.

The film F is fed through the outlet 34 of the film turning passage 32, the opening 15 of the table 13 and the first hole 1 of the leader L. When the film passes through the first hole 1, prongs 3 of the leader L are deformed resiliently by the tip of the film. When the holes 4 of the film F pass the tips of the prongs 3 (FIG. 7A), the feed roller 35 is stopped and then reversed. In order to prevent the leader L from being pushed up when the prongs 3 are pushed by the tip of the film F, it is preferable to provide a presser member for holding down the leader L toward the table 13.

While the film F is being fed through the film turning passage 32, the swing arm 50 pivots in the direction opposite to the abovementioned direction, returning to the standby position shown in FIG. 3.

By reversing the feed roller 35, the film is pulled back. When the holes 4 of the film F are pulled back and face the tips of the prongs 3, the prongs 3 will deform resiliently and engage in the holes 4. When the film is further pulled back until the tips of the prongs 3 sit on the edge of the first hole 1, the feed roller 35 stops.

Figure 4:
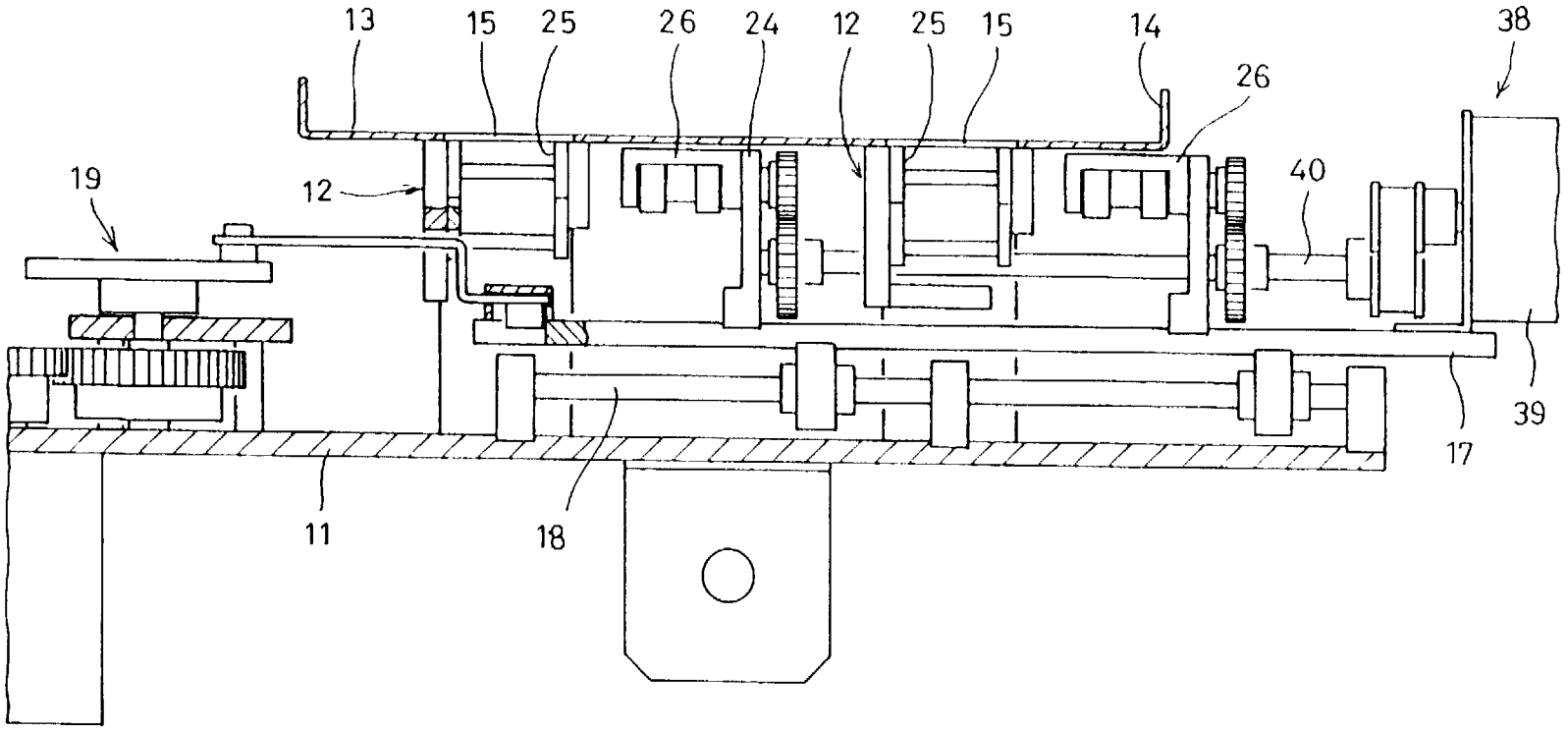
FIG. 4 is a vertical sectional view similar to FIG. 2 with a slide plate moved to a different position.

After the feed roller 35 has been stopped, the motor 20 shown in FIG. 2 is activated to move the slide plate 17 rightwardly in FIG. 2. When the movable guide 26 completely separates from the fixed guide 25 as shown in FIG. 4, the motor 20 stops. Splicing of the film is now finished.

Figure 8A:
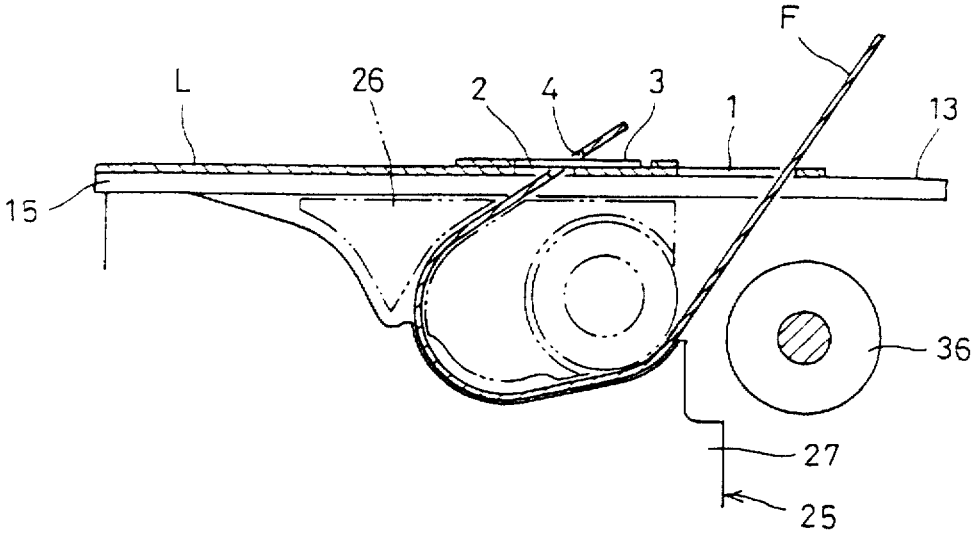
FIG. 8A is a sectional view showing a movable guide when it is moved away from a fixed guide.
Figure 8B:
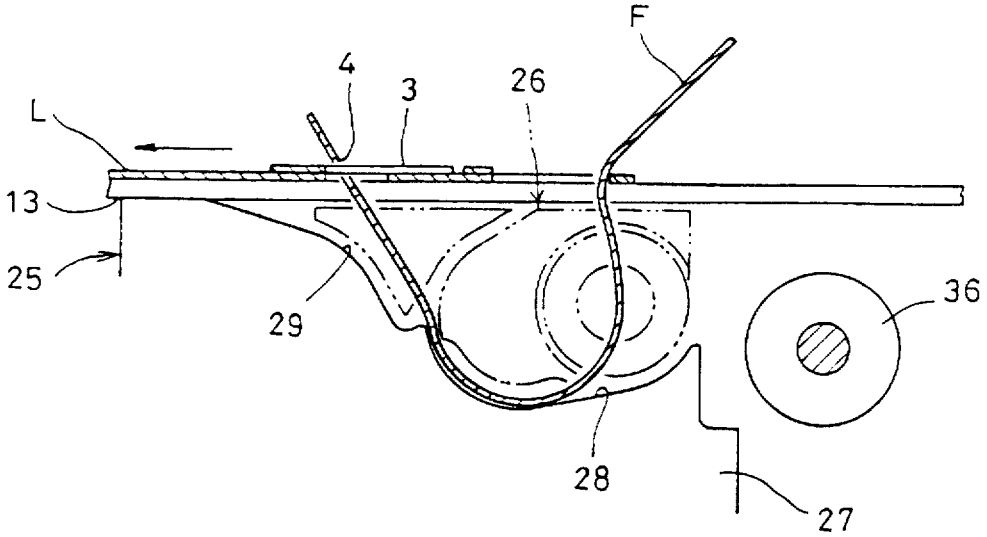
FIG. 8B is a sectional view showing a leader being fed along the top surface of a table.
Figure 9:
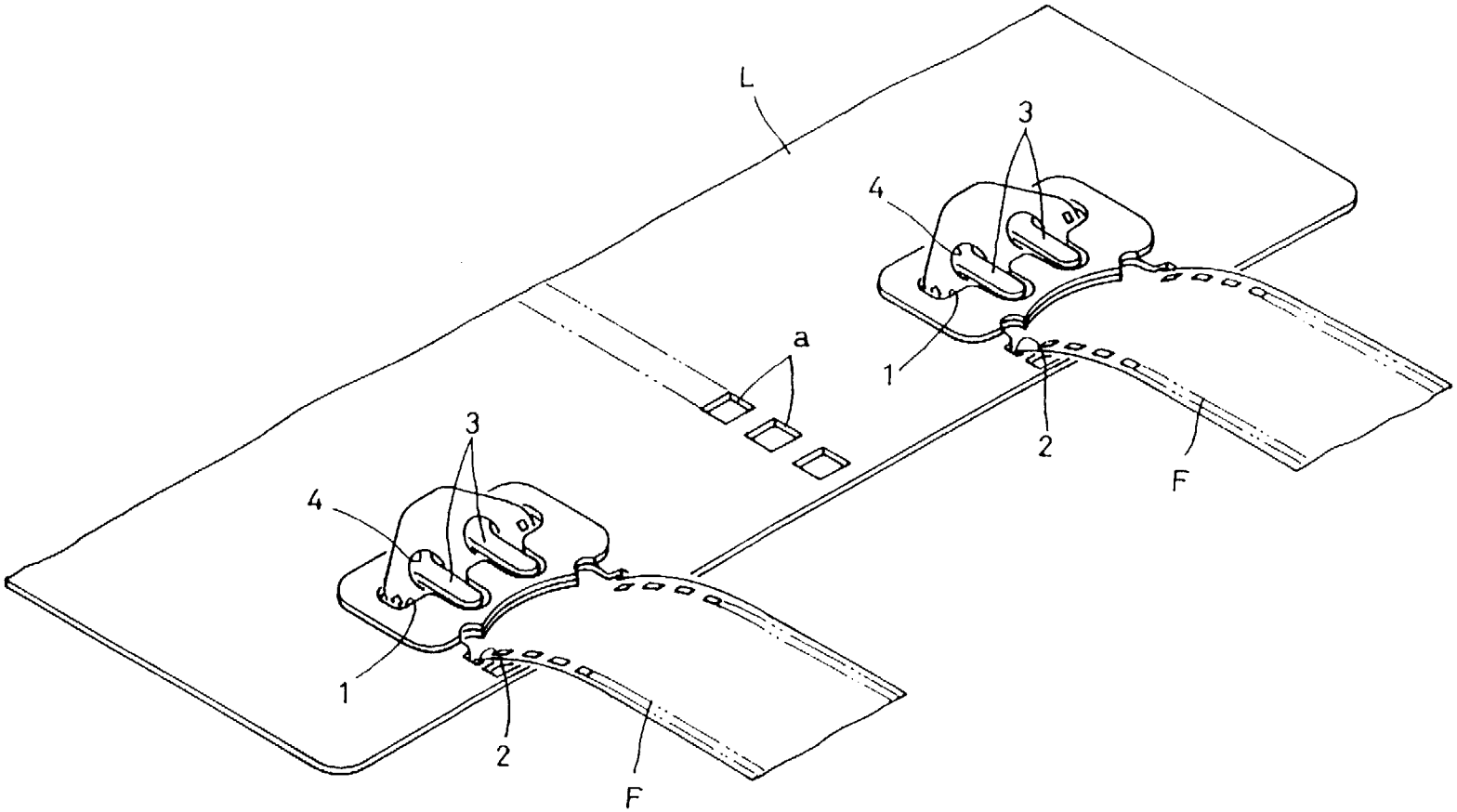
FIG. 9 is a perspective view of a leader and films spliced to the leader.

The movable guide 26 is moved sideways from the position right over the fixed guide 25 by the time the film F is connected to the leader L. Thus, it is possible to take out the leader L without damaging the film F by moving the leader along the top surface of the table 13 or raising it as shown in FIG. 8B.

According to this invention, it is possible to automatically splice a film wound in a film cartridge supported in the support portion to a leader set in position on the table by inserting the film into the second hole and then the first hole and by engaging the prongs provided on the leader to extend across the first hole into the holes formed in the leading end of the film.

(Second Embodiment)

Figure 18:
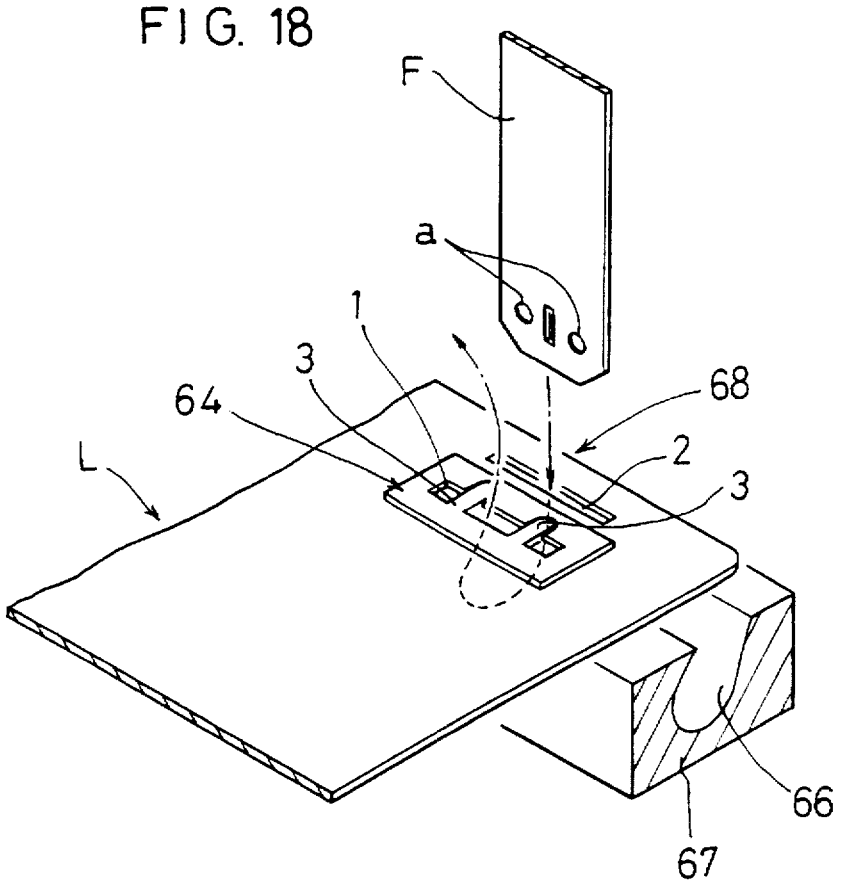
FIG. 18 is a perspective view showing how an undeveloped film is connected to a leader.

As shown in FIG. 18, a leader L is formed at its rear with front hole 1 and a rear hole 2, and has a hook 64 at the side of the front hole 1. The hook 64 has two prongs 3 spaced from each other and extending over the front hole 1.

Figure 10:
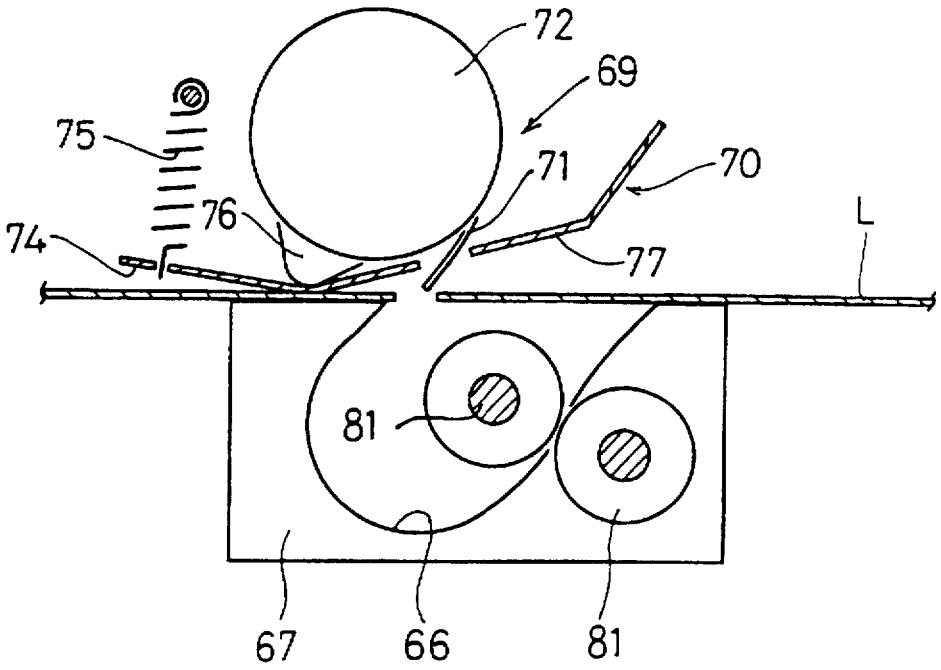
FIG. 10 is a schematic view of another embodiment of the film splicing device.

As shown in FIG. 10, the leader L is fed along a film guide 67 having a curved recess 66, and stopped when the holes 1 and 2 come right over the recess 66 of the film guide 67.

An undeveloped film F is connected at its leading end to the leader L by means of the film guide 67 as a film connecting means 68.

Over the film guide 67 is a film splicing device 69.

The film splicing device 69 comprises a leader presser 70 for pressing down the leader L, a film guide plate 71 adapted to be inserted in the hole 1, i.e. the hole where there is the hook 64, and an actuator 72 carrying the film guide plate 71 and the leader presser 70.

The actuator 72 is a cylindrical rotary member rotated in opposite directions by a driving unit (not shown). The film guide plate 71 is provided on the outer periphery of the actuator 72 so as to be insertable into the hole 1 in the leader L. Plate 71 is normally located over the leader L.

The leader presser 70 is pivotally supported by a support portion 73 at the lower part of the actuator 72. The leader presser 70 has a rear portion 74 connected to a tension spring 75. A protrusion 76 provided behind the actuator 72 urges the leader presser 70 against the force of the tension spring 75 to raise front portion 77 of the leader presser 70.

When the actuator 72 is rotated clockwise from the position of FIG. 10, the protrusion 76 separates from the leader presser 70. The front portion 77 of the leader presser 70 is thus brought down by the force of the tension spring 75 to press the leader.

Figure 13:
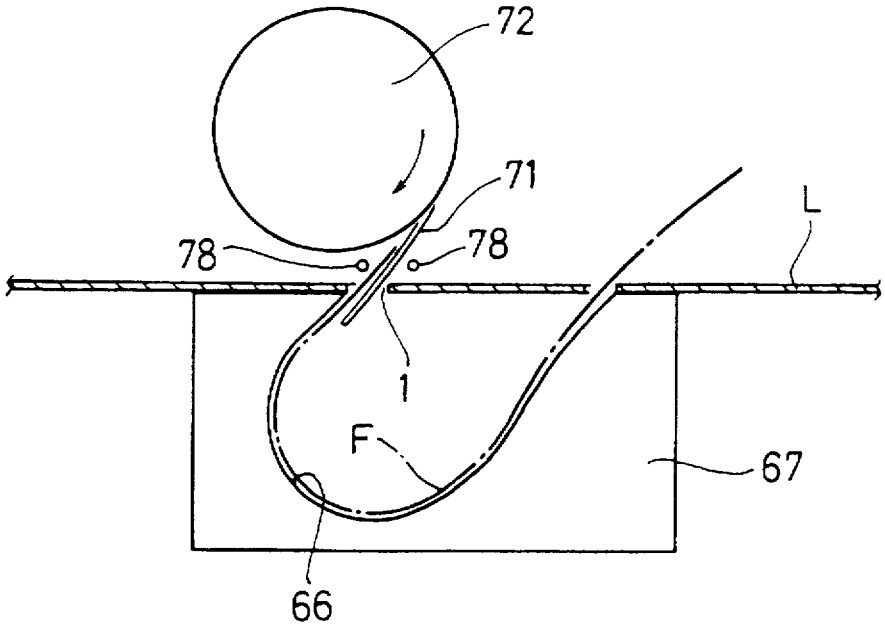
FIG. 13 is a sectional view showing a sensor for detecting an undeveloped film coming out of the hole.

As shown in FIG. 13, the film splicing device has a sensor 78 over the hole 1 formed in the leader to detect an undeveloped film F coming out of the hole 1. Sensor 78 also detects that the free end of the film guide plate 71 is in the recess 66 of the film guide 67.

Figure 16:
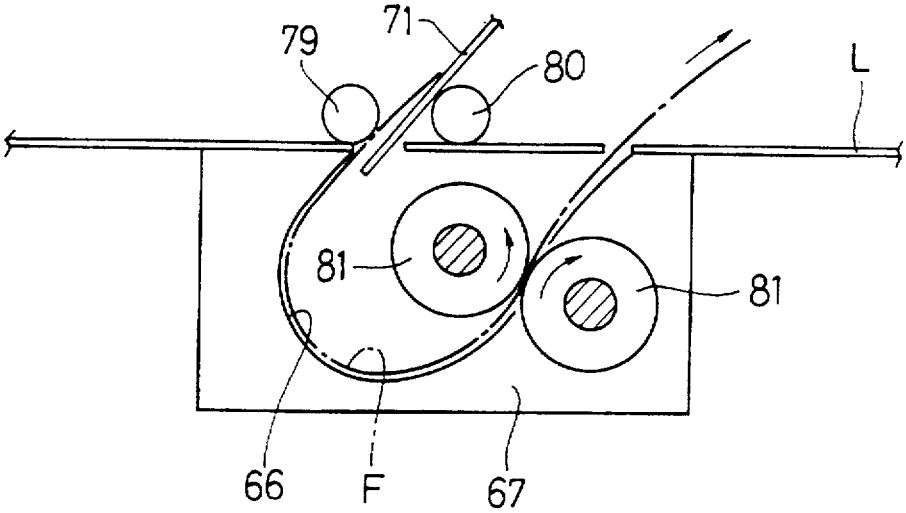
FIG. 16 is a schematic view showing how the undeveloped film is retracted slightly by reversing driving rollers.
Figure 17:
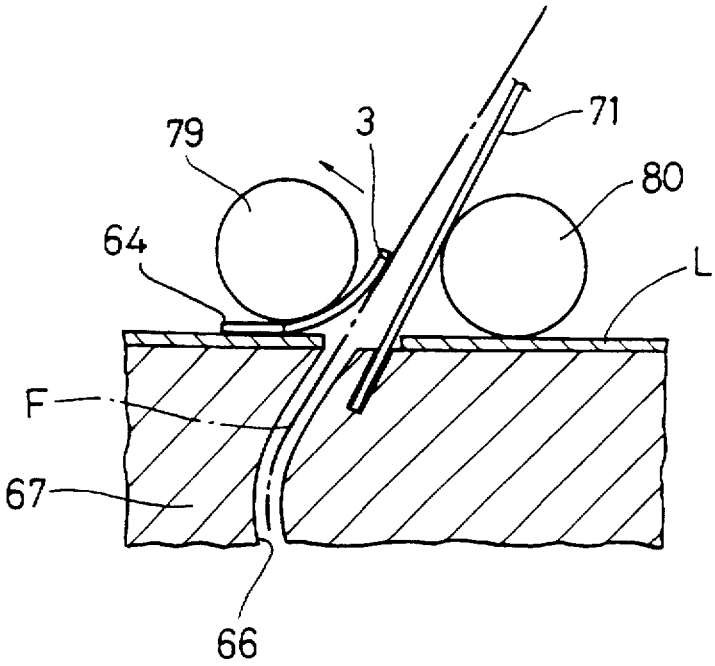
FIG. 17 is a sectional view showing how a prong of a hook is pressed by a roller.

As shown in FIGS. 16 and 17, a roller 79 is provided behind the prongs 3 of the hook 64 provided on the leader to press the prongs 3 against undeveloped film F coming out of the hole 1 while preventing the prongs 3 from being pushed back by the film F. Numeral 80 indicates a roller supporting the film guide plate 71.

Figure 11:
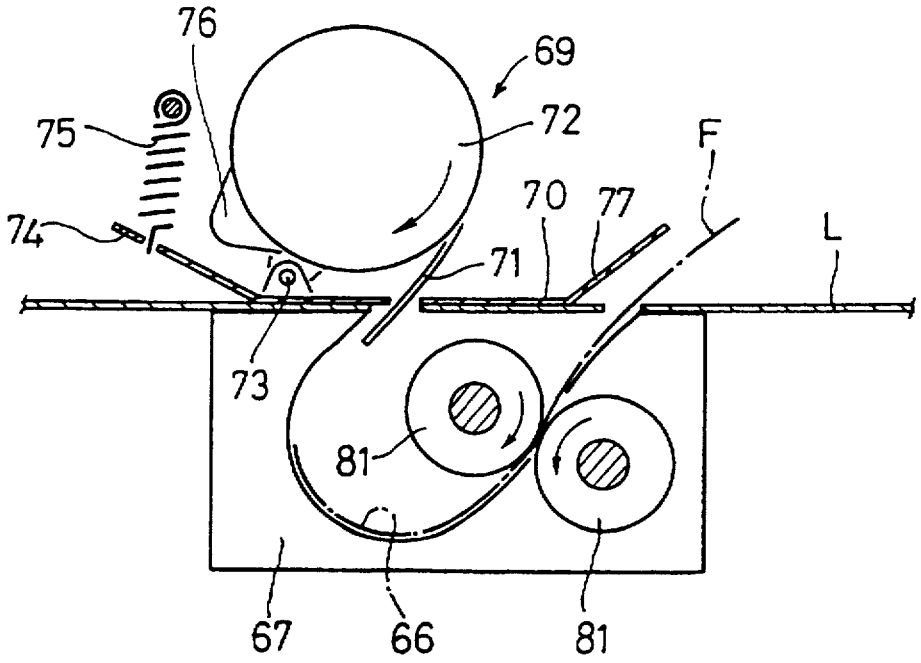
FIG. 11 is a view showing how a leader is pressed by a film presser.
Figure 12:
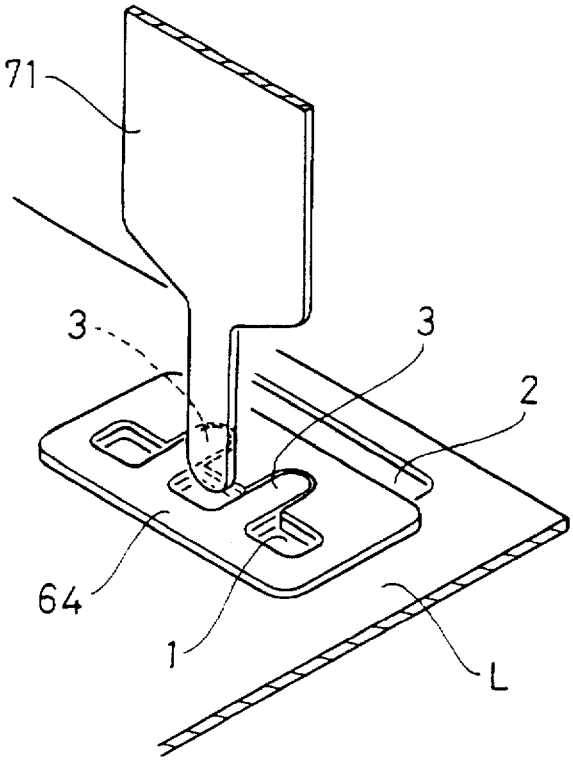
FIG. 12 is a perspective view of a film guide plate as it is inserted in a hole formed in the leader.

The film splicing device 69 further includes a pair of driving rollers 81 provided in the film guide 67, as shown in FIGS. 10, 11 and 16. By rotating the driving rollers 81 in either direction, an undeveloped film F being fed along the recess 66 is forcibly moved back and forth.

The operation of the film splicing device of this embodiment will now be described. The leader is fed as shown in FIG. 10 and stopped when its holes 1 and 2 (not shown in FIG. 10) positioned over the recess 66 of the film guide 67. The leader is thus set on the film guide 67.

The actuator 72 is then rotated in the direction of the arrow in FIG. 11. The protrusion 76 thus separates from the rear portion 74 of the leader presser 70, so that front portion 77 is brought down by the force of the tension spring 75 and pressed against the leader. The leader is thus held between the leader presser 70 and the film guide 67. At the same time, the film guide plate 71 engages in the hole 1 of the leader, i.e. the hole having the hook 64. In this state, the leading end of the film guide plate 71 is in the recess 66 of the film guide 67.

In this state, the undeveloped film F is inserted through the hole 2 into the recess 66 in the film guide 67. With the film in the recess 66, the driving rollers 81 are rotated in the directions of the arrows in FIG. 11 to feed the film along the curved recess 66.

Figure 14:
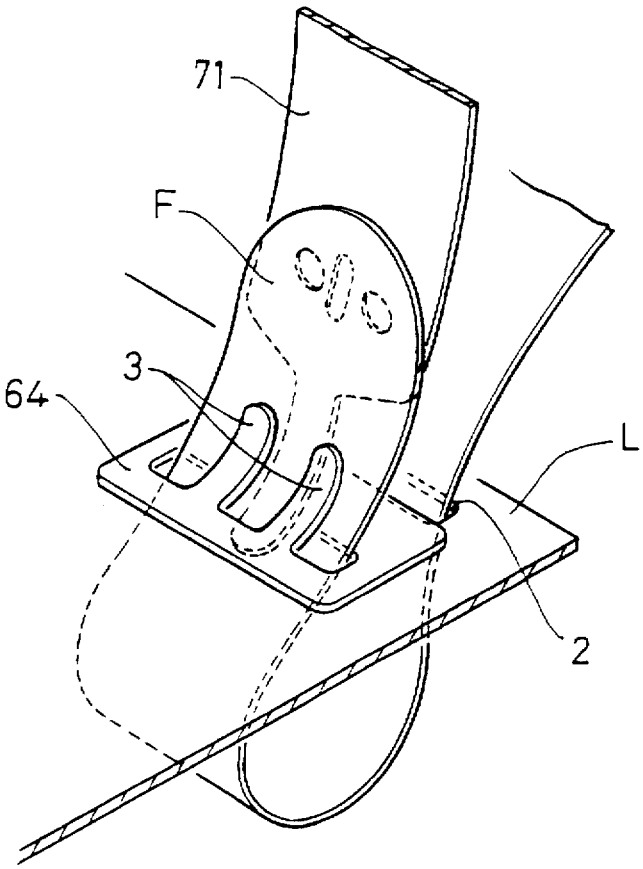
FIG. 14 is a perspective how the leading end of the undeveloped film comes out of the hole while being guided by the film guide plate.
Figure 15:
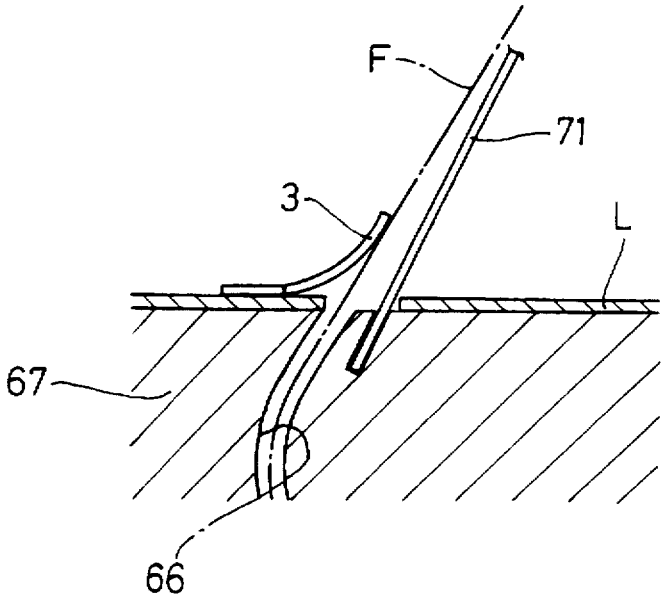
FIG. 15 is a schematic sectional view of FIG. 14.

The leading end of the film is reversed in the recess 66 and guided into and out of the hole 1 of the leader, while sliding along the film guide plate 71 inserted in the hole 1 (FIGS. 14 and 15).

When the sensor 78 (shown in FIG. 13) detects that the leading end of the undeveloped film has come out of the hole 1, the driving rollers 81 are reversed as shown in FIG. 16 to slightly retract the undeveloped film F until the prongs 3 of the hook 64 engage in holes a formed in the undeveloped film F (FIG. 18). The film is thus connected to the leader. The sensor 78 detects that the film guide plate 71 is in the recess 66 of the film guide 67.

With the film F connected to the leader, the actuator 72 is reversed to raise the leader presser 70 by pressing its rear portion 74 with the protrusion 76. The leader, which is now freed from the leader presser 70 and to which is connected the undeveloped film, is fed into an automatic developing machine (not shown).

The above operation is repeated to connect films to a plurality of leaders one after another.

What is claimed is:

1. A film splicing device for splicing a film to a leader formed with a first hole, a second hole and protrusions, said film splicing device being adapted to guide an end of the film through the second hole formed in the leader and then through the first hole formed in the leader adjacent the second hole while resiliently deforming the protrusions formed on the leader and extending across the first hole, and then to pull back the film with the protrusions being resiliently deformed to cause the protrusions to engage in holes formed in the film, said film splicing device comprising:

a table having a substantially flat top surface for supporting the leader, said table having in said top surface a film inserting elongated opening;

a film cartridge support portion located over said opening for supporting a film cartridge in which is wound a film;

a fixed guide positioned directly under said opening and a movable guide provided under said table, said movable guide being movable above said fixed guide in the direction of a width of said table to and away from a position right over said fixed guide, said movable guide and said fixed guide being so positioned that a film turning passage is defined therebetween when said movable guide is right over said fixed guide, said film turning passage having a film inlet and a film outlet both open to said top surface of said table;

a feed roller movable in said direction of said width of said table together with said movable guide so as to be located near said inlet of said film turning passage when said film turning passage is formed;

a press roller pressed against said feed roller with a film sandwiched therebetween; and a film pulling means for pulling the film out of the film cartridge supported on said support portion and guiding the film through the second hole formed in the leader placed on said table into said inlet of said film turning passage.

2. A film splicing device as claimed in claim 1, wherein said film pulling means comprises a swing arm pivotable from under said table toward said table, and an arcuate plate mounted on a free end of said swing arm and adapted to be inserted in the second hole in the leader, said arcuate plate having a free end having catches adapted to engage holes formed in the film.

3. A film splicing device for splicing a film to a leader formed with a first hole, a second hole and protrusions, said film splicing device comprising:

a film guide having a top guide surface for supporting the leader, said film guide having formed therein an arcuately curving recess extending inwardly of said top guide surface;

whereby the film can be connected to the leader by inserting a leading end of the film into the second hole, guiding the film along said curved recess to turn the film, and inserting the film leading end into the first hole;

an actuator provided near said top guide surface of said film guide;

a leader presser and a film guide plate mounted on said actuator, said leader pressing being adapted to press the leader against said top guide surface, and said film guide plate being sized and positioned such that it can be inserted into the first hole of the leader from top thereof by activation of said actuator; and said curved recess being sized, shaped and positioned such that the leading end of the film inserted into the second hole of the leader from top thereof is inserted into said curved recess, and is turned while being guided along said curved recess so as to be directed toward the first hole of the leader when exiting said curved recess.

4. A film splicing device as claimed in claim 3, further comprising a sensor provided at a position to be located over the first hole of the leader.

5. A film splicing device as claimed in claim 4, further comprising a press roller provided at a position to be located behind the protrusions to keep the protrusions pressed against the film which has been inserted into the first hole of the leader.

6. A film splicing device as claimed in claim 5, further comprising a pair of driving rollers provided in said film guide and adapted to be rotated in opposite directions to feed an undeveloped film forwardly and backwardly along said curved recess.

7. A film splicing device as claimed in claim 4, further comprising a pair of driving rollers provided in said film guide and adapted to be rotated in opposite directions to feed an undeveloped film forwardly and backwardly along said curved recess.

8. A film splicing device as claimed in claim 3, further comprising a pair of driving rollers provided in said film guide and adapted to be rotated in opposite directions to feed an undeveloped film forwardly and backwardly along said curved recess.

9. A film splicing device as claimed in claim 3, further comprising a press roller provided at a position to be located behind the protrusions to keep the protrusions pressed against the film which has been inserted into the first hole of the leader.

* * * * *